United States Patent [19]

Cullen

[11] Patent Number: 4,494,650

[45] Date of Patent: Jan. 22, 1985

[54] DISPLAY PACKAGE

[75] Inventor: John F. Cullen, Demarest, N.J.

[73] Assignee: Dimensional Merchandising, Inc., West Caldwell, N.J.

[21] Appl. No.: 524,388

[22] Filed: Aug. 18, 1983

[51] Int. Cl.[3] ..... B65D 85/00; B65D 21/02; B65D 6/00; B65D 25/00

[52] U.S. Cl. ..... 206/45.34; 206/315.9; 206/503; 220/4 B; 220/4 E; 220/306; 229/2.5 R

[58] Field of Search ..... 206/45, 34, 45.31, 315.9, 206/503; 220/306, 4 E, 4 B; 229/2.5 R

[56] References Cited

U.S. PATENT DOCUMENTS

| | | | |
|---|---|---|---|
| 1,861,948 | 6/1932 | Barkdoll | 206/315.9 |
| 3,164,478 | 1/1965 | Bostrom | 229/2.5 |
| 3,311,229 | 3/1967 | Troll et al. | 220/306 |
| 3,933,295 | 1/1976 | Congleton | 206/403 |
| 3,987,893 | 10/1976 | Hanson | 206/45.31 |

FOREIGN PATENT DOCUMENTS

| | | | |
|---|---|---|---|
| 1529853 | 5/1968 | France | 220/4 E |
| 258424 | 3/1927 | Italy | 220/4 E |

*Primary Examiner*—William T. Dixson, Jr.
*Attorney, Agent, or Firm*—Elliot M. Olstein

[57] ABSTRACT

There is disclosed an improved display package comprising a first body member having a top wall, a cylindrically shaped side wall and a circumferential shoulder member extending outwardly from the terminus of the side wall and a second body member having a top wall, a cylindrically shaped side wall and a circumferential shoulder member extending outwardly from the terminus of the side wall. First body member and the second body member are cooperatively engageable through the use of snap means located on each respective circumferential shoulder member.

10 Claims, 5 Drawing Figures

DISPLAY PACKAGE

FIELD OF THE INVENTION

This invention relates to an improved display package and more particularly to an improved display package for a soccerball, volleyball, basketball, footballs, baseballs and the like.

BACKGROUND OF THE INVENTION

Athletic equipment, such as soccerballs, volleyballs, basketballs and the like are presently sold in numerous fashions. They are sold unpackaged either non-inflated or inflated or they are sold in paper cartons. The simplest type of paper carton has been the box type wherein the inflated diameter of the item corresponds to the internal dimensions of the box. As can be realized, no portion of the ball to be sold is visible. At the point of sale, this is undesirable since a prospective purchaser is unable to see the ball. Another form of conventional carton for a soccerball and the like includes partially open front and rear panels so as to expose the front and back of the ball. As with the previous box type of carton the carton is dimensioned to the inflated diameter of the item to be contained therein. As can readily be determined as the ball deflates while in the carton it tends to move in the carton in addition to affecting the capability of multi-stacking of the cartons.

A third type of paper carton is disclosed in U.S. Pat. No. 3,987,893 to Hanson comprised of a paperboard blank capable of being erected into a display carton for supporting a basketball, football or the like. When erected the display carton has an open front face for displaying the item to be stored. The dimensions of the container again are restricted to the inflated diameter of the ball to be contained therein. As with the previously described cartons, if the ball deflates, the stability of the carton is hindered thereby hindering the stacking ability of the carton. Additionally, the movement of the ball is restricted in the carton thereby preventing a perspective purchaser from examining totally the soccerball, basketball or the like contained therein.

OBJECTS OF THE INVENTION

An object of the present invention is to provide an improved display package.

Another object of the present invention is to provide an improved display package for soccerballs, volleyballs, basketballs or the like.

Yet another object of the present invention is to provide an improved display package capable of totally displaying the item contained therein and not obscuring the item as paper, chipboard, corrugated paper or other opaque material packages.

Still another object of the present invention is to provide an improved display package capable of providing improved package rigidity not dependent on the item packaged for multi-stacking purposes.

Still yet another object of the present invention is to provide an improved display package having interlocking devices for multi-stacking purposes.

A further object of the present invention is to provide an improved display package having internal returns for supporting the item contained therein.

SUMMARY OF THE INVENTION

These and other objects of the present invention are achievd by an improved display package comprising a first body member having a top wall, a cylindrically shaped side wall and a circumferential shoulder member extending outwardly from the terminus of the side wall and a second body member having a top wall, a cylindrically shaped side wall and a circumferential shoulder member extending outwardly from the terminus of the side wall. First body member and the second body member are cooperatively engageable through the use of snap means located on each respective circumferential shoulder member.

BRIEF DESCRIPTION OF THE DRAWINGS

A clearer understanding of the present invention will be facilitated by reference to the accompanying detailed description of the invention when considered in view of the following drawings, wherein.

DETAILED DESCRIPTION OF THE INVENTION

Figure 1:
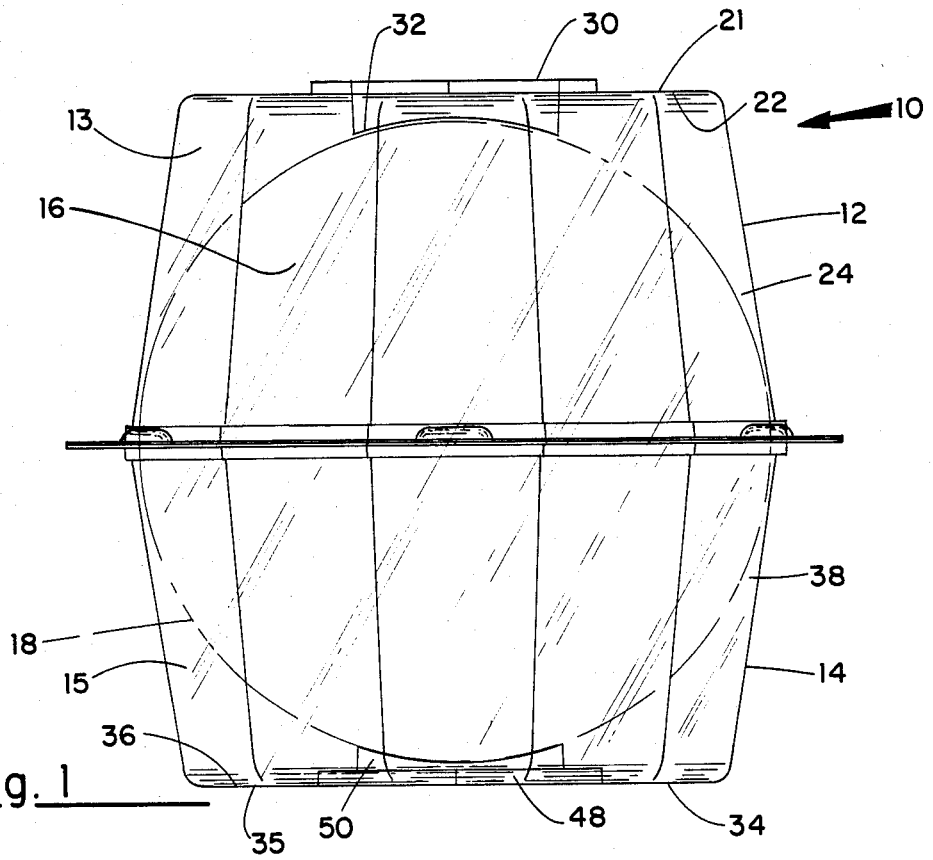
FIG. 1 is a front elevational view of the present invention showing the male and female snap members and a soccerball contained therein.

Now referring to FIG. 1, there is shown an improved display package, generally indicated as 10, comprised of a top member 12 having a cavity 13 engageable to a bottom member 14 having a cavity 15 which together cooperatively form a storage chamber 16. Contained within said storage cavity 16 of said display package 10 is a ball 18, such as a soccerball, basketball, volleyball, football, baseball or the like. Display package 10 can be formed from any clear thermoplastic material, such as polyvinyl chloride, styrene or the like.

Figure 2:
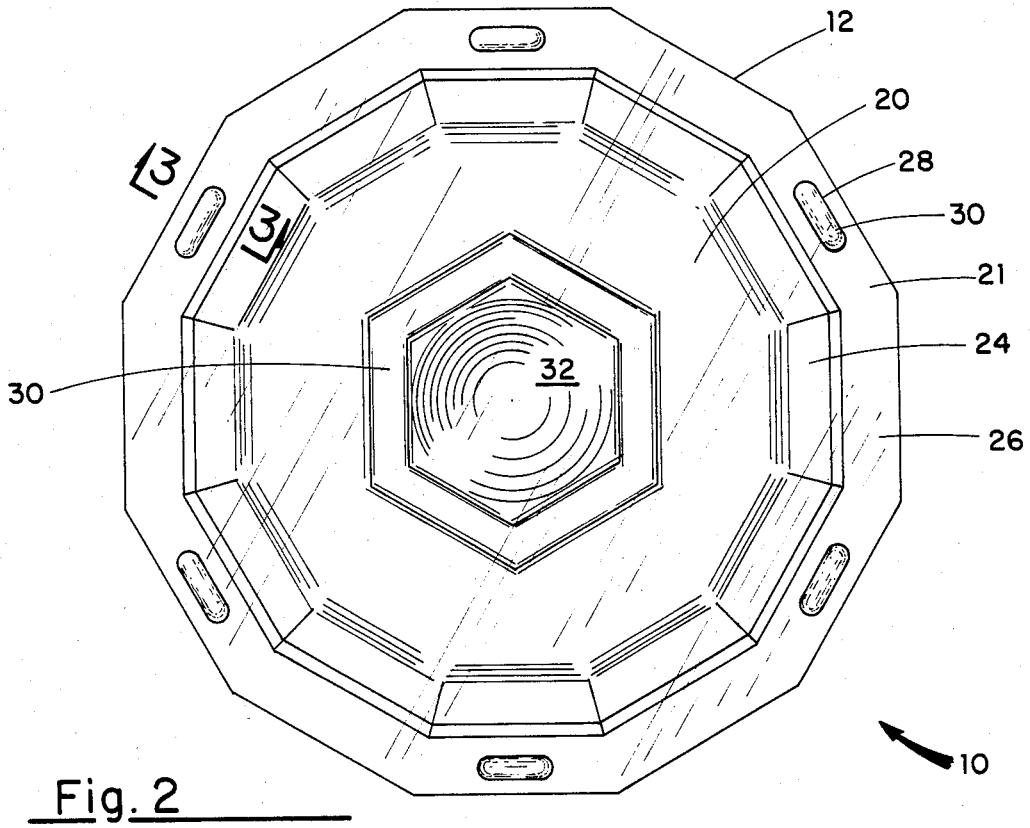
FIG. 2 is a top view of the top half of the present invention showing the male interlocking member.

Now referring to FIG. 2, there is shown top member 12 formed with a top wall 20 having an outside surface 21 and an inside surface 22, a side wall 24 extending downwardly from the top wall 20 and a circumferential shoulder member 26 extending outwardly from the terminal end of the side wall 24. Cylindrically shaped side wall 24 may be cylindrical or polygonal in shape and flared outwardly from a perpendicular plane to the top wall 20. Additionally when polygonal, side wall 24 may be faceted as shown in FIGS. 1 and 2 to provide rigidity to the display package. A series of female locking orifices 28 are bored through the circumferential shoulder member 26. The purpose of locking orifices 28 will be more fully explained.

Formed on the top wall 20 is a male interlocking member 30 extending above the plane of the outside surface 21 of top wall 20. Male interlocking member 30 is preferably a polygonal or circular ridge. Formed in the center of male interlocking member 30 and extending downwardly from the inside surface 22 is an internal return 32. Internal return 32 is concave such that the depth of the concave arc is even with or below the plane of top wall 20.

With respect to bottom member 14 formed with a top wall 34 having an outside surface 35 and an inside surface 36, a cylindrically shaped side wall 38 extending upwardly from the top wall 34 and a circumferentially shoulder member 40, extending outwardly from the terminal end of the side wall 38. As with top member 12, side wall 38 of bottom member 14 can be cylindrical or have faceted sides. The number of faceted sides of bottom member 14 is equal to the number of faceted sides of top member 12.

Figure 3:
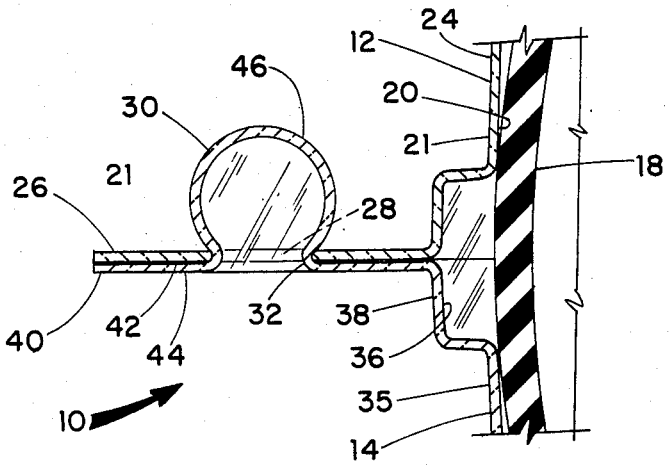
FIG. 3 is a cross-sectional view taken along the line 3—3 of FIG. 2 showing the snap closure members of the present invention.
Figure 4:
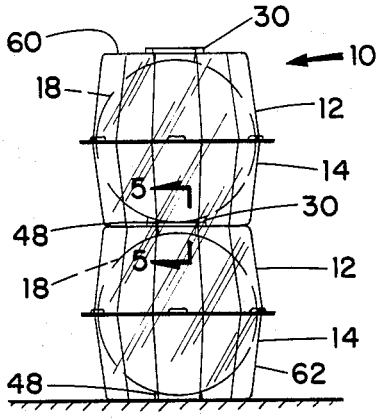
FIG. 4 is a perspective view of two improved display packages, stacked one on top of the other.

Referring now to FIG. 3, there is shown, circumferential shoulder member 40, which is formed with a top surface 42 and a bottom surface 44. On bottom surface 44 there are formed a series of male snap members 46. The number of male snap members 46 corresponds with the number of female locking orifices 28 positioned on the circumferential shoulder member 26 on said top member 12. In practice, the circumferential shoulder member 26 of top member 12 is positioned on the circumferential shoulder member 40 of the bottom member 14 such that the male snap members 46 are inserted through female locking orifices 28 to seal and thereby form display package 10 as shown in FIG. 4.

Formed on the top wall 34 of bottom member 14 is a female interlocking member 48 extending below the plane of top wall 34. Female interlocking member 48 is preferably a circular or polygonal depression formed to cooperatively engage the correspondingly shaped male interlocking member 30 of top member 12.

Figure 5:
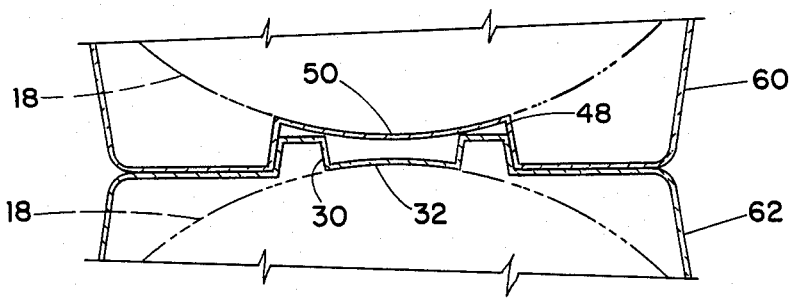
FIG. 5 is a cross-sectional view taken along the line 5—5 of FIG. 4 showing the male-female interlock assembly.

Now referring again to FIGS. 4 and 5, there is shown a first display package 60 and a second display package 62 in a stacked relationship whereby the bottom member 14 of display package 60 is positioned and interlocked with the top member 12 of display package 62 through the use of male interlocking means and female interlocking means as previously hereinabove described.

As in top member 12, there is formed in the center of female interlocking member 48 on top wall 34 of bottom member 14 an internal return 50 extending downwardly from the inside surface 36. As with internal return 32 of top member 12, internal return 50 is concave in shape such that the depth of the concave arc is even with or below the plane of top wall 34. The purpose of internal returns 32 and 50 is to provide for the positioning of the ball 16 in the display package 10 and additionally to vertically support the package.

The dimensions of the display package is dependent on the size of the ball 16 to be packaged, that is the height from the internal return 50 of bottom member 14 to the internal return 32 of top member 12 is somewhat more or substantially equal to the inflated diameter of ball 16 to be packaged. Additionally, the width of display package 10 is also equal to the inflated diameter of ball 16.

Numerous modifications and variations of the above disclosed invention are possible in light of the above teaching and therefore, within the scope of the appended claims. The invention may be practiced otherwise than as particularly described.

What is claimed:

1. A display package, comprising:

a first bowl-shaped transparent body member; a second bowl-shaped transparent body member, each of the first and second body members having an open end and an internal cavity, said first and second body members being positioned with the respective open ends adjacent to each other to form a chamber for a ball; connecting means for connecting the first and second body members to each other to form said chamber, said first body member forming an upper portion of the package and the second body member forming a bottom portion of the package, said top portion of the package including a top supporting surface for supporting a package to be stacked thereon, the bottom portion of the package including a bottom base surface for the package; one of said top supporting surface and bottom base surface including a male portion of a male-female member and the other of said top supporting surface and said bottom base surface including a female portion of the male-female member, whereby said packages can be stacked on each other with the bottom base surface of one package supported on the top supporting surface of a second package with said male member being inserted in said female member to prevent lateral movement between the packages.

2. The display package of claim 1 wherein the first and second body members have faceted walls to increase the rigidity of the package.

3. The package of claim 2 wherein the interior portion of at least one of the top supporting surface and the bottom base surface includes a recess for positioning a ball in the package.

4. The package of claim 3 wherein the top supporting surface and the bottom base surface are in substantially parallel planes.

5. The package of claim 2 wherein the chamber has a substantially spherical shape corresponding to the shape of a soccer ball, and said display package includes a soccer ball.

6. The package of claim 1 wherein the chamber had a substantially spherical shape corresponding to the shape of a volleyball and the chamber includes a volleyball.

7. The package of claim 1 wherein the chamber had a substantially spherical shape corresponding to the shape of a basketball, and the chamber includes a basketball.

8. The package of claim 1 wherein the chamber has a substantially spherical shape corresponding to the shape of a baseball, and the package includes a baseball.

9. The display package of claim 1 wherein the connecting means is comprised of a male locking member on one of said first and second body members and a female locking member on the other of said first and second body members.

10. The display package of claim 1 wherein the male portion and the female portion are centrally positioned on the package.

* * * * *